US006854434B2

(12) United States Patent
Methley

(10) Patent No.: US 6,854,434 B2
(45) Date of Patent: Feb. 15, 2005

(54) ENGINE WITH VARIABLE VALVE MECHANISM

(75) Inventor: Ian Methley, Witney (GB)

(73) Assignee: Mechadyne PLC, Kidlington (GB)

( * ) Notice: Subject to any disclaimer, the term of this patent is extended or adjusted under 35 U.S.C. 154(b) by 0 days.

(21) Appl. No.: 10/719,447

(22) Filed: Nov. 21, 2003

(65) Prior Publication Data

US 2004/0099231 A1 May 27, 2004

(30) Foreign Application Priority Data

Nov. 23, 2002 (GB) ..... 0227417

(51) Int. Cl.[7] ..... F01L 1/34

(52) U.S. Cl. ..... 123/90.16; 123/90.27; 123/90.39; 123/90.44; 74/569

(58) Field of Search ..... 123/90.16, 90.27, 123/90.31, 90.6, 90.39, 90.41, 90.43, 90.44, 90.45; 74/559, 569

(56) References Cited

U.S. PATENT DOCUMENTS 5,456,226 A * 10/1995 Doll ..... 123/90.16
5,515,820 A * 5/1996 Sugimoto et al. ..... 123/90.16
6,295,958 B2 * 10/2001 Pierik ..... 123/90.16

* cited by examiner

*Primary Examiner*—Thomas Denion
*Assistant Examiner*—Ching Chang
(74) *Attorney, Agent, or Firm*—Smith-Hill and Bedell

(57) ABSTRACT

An overhead camshaft internal combustion engine is disclosed having a valve mechanism which comprises an intake or exhaust poppet valve 14 having a valve stem operated by two cams 16 and 18 mounted for rotation about a common axis. A first rocker 20 mounted on a pivot shaft 26 acts between the first cam 16 and the valve 14. A second rocker 28 is mounted in the engine on a fixed pivot shaft 30 and acts between the second cam 18 and the pivot shaft 26 of the first rocker 20, to raise and lower the pivot point 26 of the first rocker 20 cyclically in synchronism with the rotation of the second cam 18.

9 Claims, 2 Drawing Sheets

ENGINE WITH VARIABLE VALVE MECHANISM

FIELD OF THE INVENTION

The present invention relates to an overhead camshaft internal combustion engine having a valve mechanism which enables the valve event duration to be varied.

BACKGROUND OF THE INVENTION

The closest prior art to the present invention is believed to be WO03/016684 which is incorporated herein by reference. In the latter patent specification, a summation lever following the movements of two cams is pivotably mounted on a rocker to open a poppet valve by an amount equal to the sum of the lifts occasioned by the separate cams. By varying the phase of the two cams relative to one another, the event duration and the valve lift can be modified and by simultaneously varying the phase of both cams in relation to the engine crankshaft, the valve timing can be modified.

A disadvantage of this earlier proposal is that it requires the cylinder head architecture to be redesigned.

OBJECT OF THE INVENTION

The present invention seeks to provide an alternative installation package better suited to engines with a rocker operated valve train which avoids the need to remodel the cylinder head while still permitting the event duration to be modified.

SUMMARY OF THE INVENTION

According to the present invention, there is provided an overhead camshaft internal combustion engine having a valve mechanism which comprises an intake or exhaust poppet valve having a valve stem, two cams mounted for rotation about a common axis, a first rocker mounted on a pivot shaft and acting between the first cam and the valve stem to open and close the poppet valve in synchronism with the rotation of the first cam, and a second rocker mounted in the engine on a fixed pivot shaft and acting between the second cam and the pivot shaft of the first rocker, to raise and lower the pivot point of the first rocker cyclically in synchronism with the rotation of the second cam.

It is preferred for the valve mechanism to be symmetrical so as to avoid any twisting moment on the pivot shaft of the first rocker about an axis transverse to the axis of rotation of the cams.

In an engine having two valves per cylinder, the valve mechanism may comprise two first rockers following the movements of two first cams which are arranged symmetrically on opposite sides of a single second cam and second rocker.

In an engine having a single valve per cylinder, the pivot shaft of the first rocker may be carried by two second rockers following two second cams which are symmetrically arranged one on each side of the first cam and first rocker.

If a phase changing mechanism is provided to vary the phase of the first cam relative to the second cam then the event duration will be adjustable. While altering the relative phase of the first and second cams to vary the event duration, the valve lift achieved during an event will also be varied.

A further phase change mechanism is preferably provided to vary the phases of both the first cam and the second cam simultaneously in relation to the phase of the engine crankshaft, to allow the timing of the valve event to be set independently of the event duration and valve lift.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
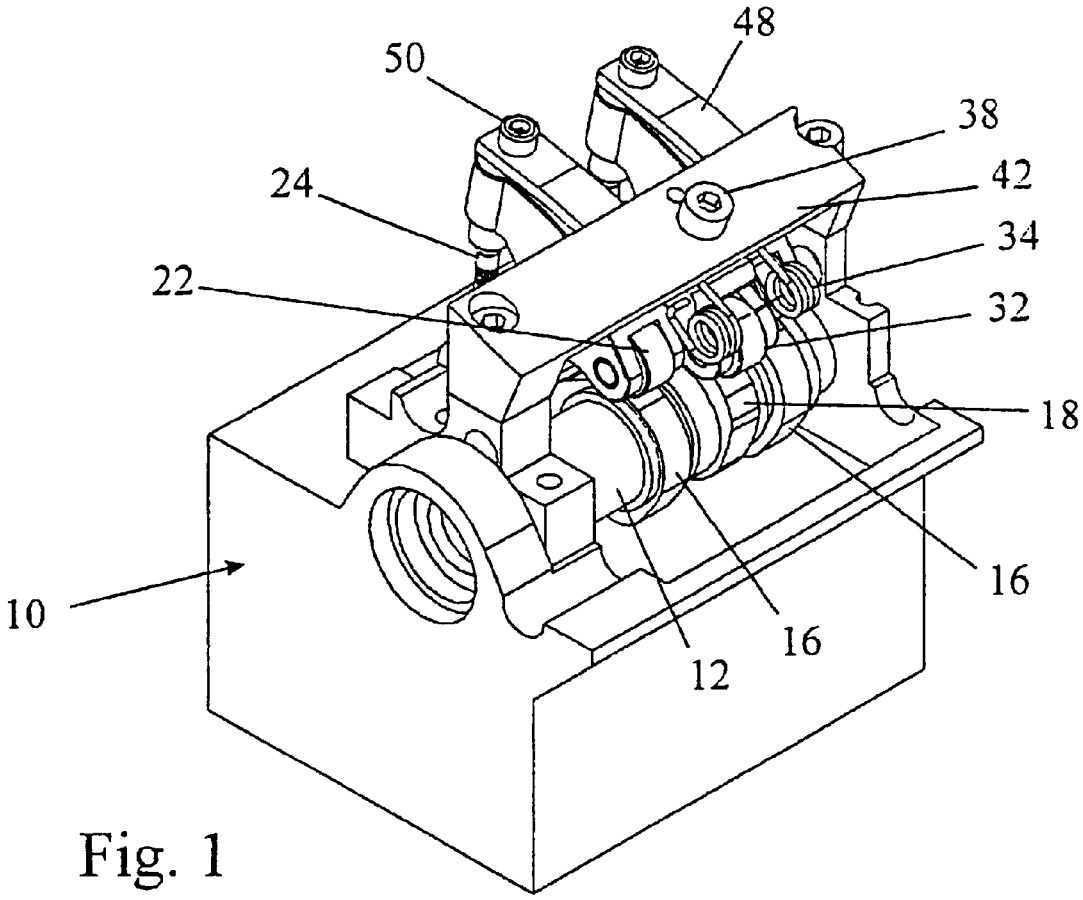
FIG. 1 is an isometric view of part of an engine cylinder head fitted with a valve mechanism.
Figure 2:
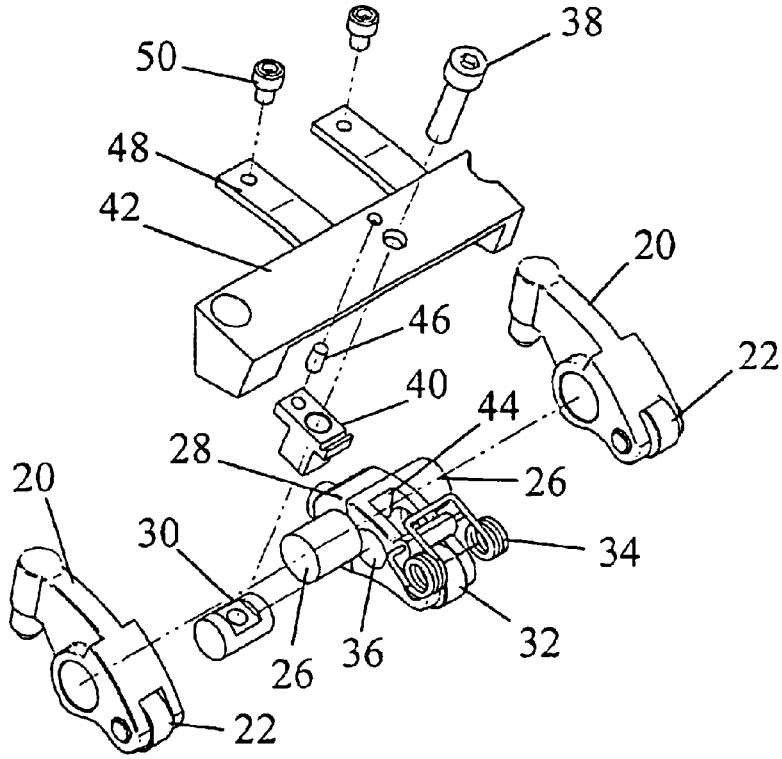
FIG. 2 is an exploded view separately showing the components of the valve mechanism.
Figure 3:
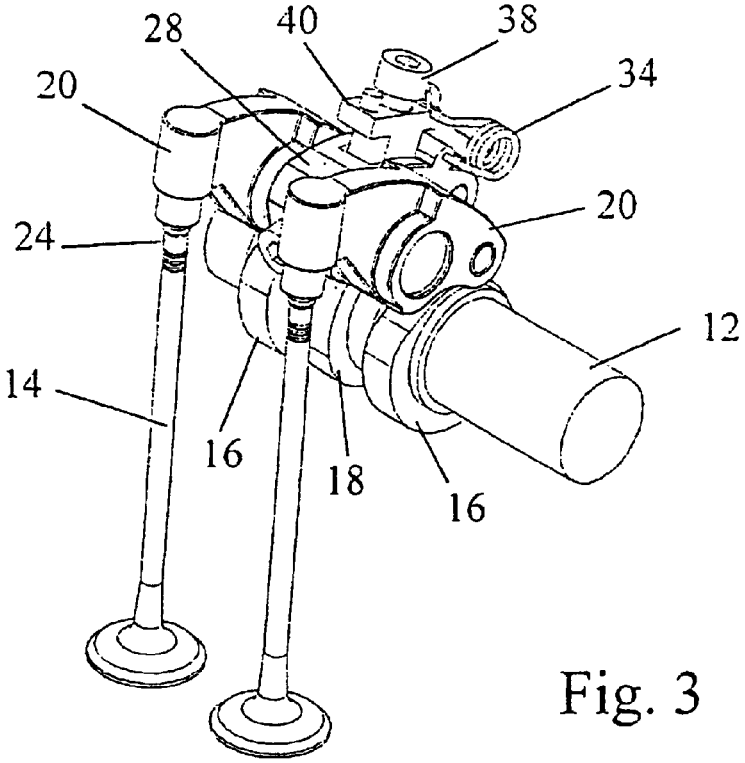
FIG. 3 is an isometric view of the assembled valve mechanism with the parts of the cylinder head omitted.

The engine shown in part in FIG. 1 has a cylinder head generally designated 10. A camshaft 12 is journalled in the cylinder head 10 and has two sets of cams that are mounted for a limited degree of angular movement relative to one another. For example, the camshaft may comprise a central shaft secured for rotation with one set of cams and surrounded by a sleeve that is rotatable with a second set of cams.

A phase change mechanism such as shown in FIG. 10 of the above referenced PCT/GB2002/003804 is used to vary the phase of the sets of cams relative to one another. Another such phase change mechanism may be used to adjust the phases of both sets of cams simultaneously in relation to the phase of the engine crankshaft. The construction and operation of the phase change mechanism will not be described herein in detail as it is in itself well known. Furthermore, numerous alternative constructions of phase change mechanism, as disclosed in the prior art, may be used to vary the phases of the cams in the present invention.

The illustrated engine has two poppet valves 14 per cylinder. These may be either intake or exhaust valves, the other valve(s) of the cylinder not being shown. The valve mechanism now to be described opens and closes the poppet valves 14 and allows the valve event duration and valve lift to be varied by varying the relative phase of the cams on the camshaft 12.

In the illustrated embodiment, the camshaft 12 has two first cams 16 arranged one on each side of a second cam 18. Two first rockers 20 carry roller followers 22 and are pivoted about a common shaft 26. The opposite ends of the first rockers 20 act by way of respective hydraulic tappets 24 on the ends of the valve stems of the poppet valves 14.

The pivot shaft 26 of the first rockers 20 is carried by, or forms part of, a single second rocker 28 that is pivotable about a stationary pivot pin 30 and has a roller follower 32 held in permanent contact with the cam 18 by means of a spring 34. The pivot pin 30 is received in a bore 36 in the second rocker 28. The pivot pin 30 secured by means of a bolt 38 to a cross bar 42 which is itself bolted to the cylinder head 10. The bolt 38 passes through a spacer block 40 which is received in an opening 44 in the second rocker 28. A pin 46 prevents rotation of the spacer block 40 relative to the cross bar 42.

Two arms 48 projecting from the cross bar 42 are fitted with adjustable stop screws 50 which serve to prevent over expansion of the hydraulic lash adjusters 24.

In common with PCT/GB 2002/003804, the illustrated valve mechanism operates by adding the profiles of the two cams 16 and 18 in order to generate the valve motion. However, the function of the summation lever is performed in the present invention by the interaction of the two rockers 20 and 28.

Figure 4:
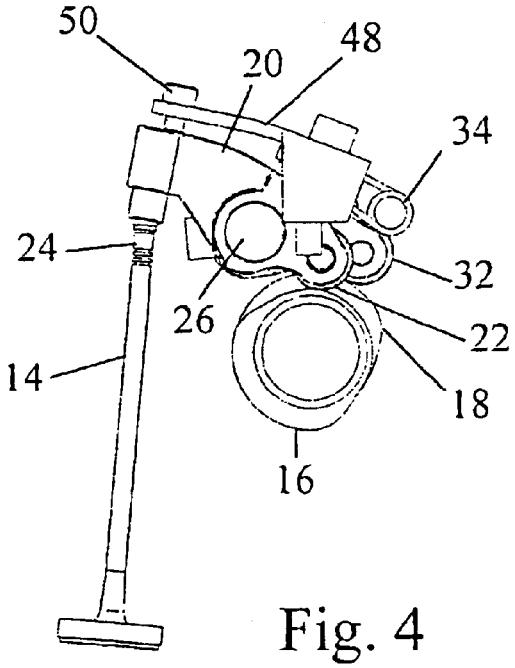
FIGS. 4 and 5 are front views of the valve mechanism in different positions.
Figure 5:
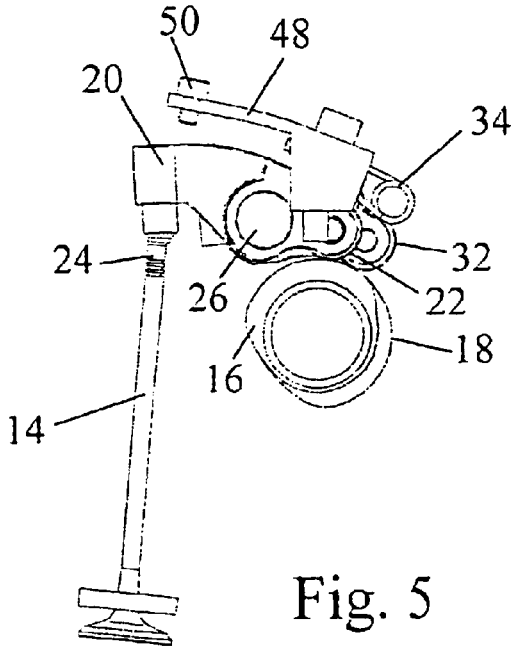

FIGS. 4 and 5 show the cams 16 and 18 with the necessary relative phase to achieve maximum valve lift.

FIG. 4 shows the valve 14 fully closed and FIG. 5 shows it fully open.

At the beginning of valve lift, as shown in FIG. 4, the middle cam 18 contacts its follower 32 on the maximum lift dwell portion of the profile, that is to say the top of the cam lobe. This holds the moving pivot shaft 26 in its lowest possible position. As the outer cams 16 now move from their base circle radii to the lift profile, the valve is lifted from its seat.

Maximum valve lift occurs, as shown in FIG. 5, when the cam followers 22 and 32 are both on the cam lobes. The maximum possible valve lift will therefore occur if the cams 16 and 18 are phased such that both of the profiles contact their followers at maximum lift at the same time.

The valve 14 will be closed if either of the cam followers 22 and 32 is on the base circle radius of its associated cam. If the cam follower 22 comes off its cam lobe while the follower 32 remains on its cam lobe, the rocker 20 pivots about the pivot shaft 26 to close the valve. On the other hand, if the cam follower 22 remains on the cam lobe while the cam follower 32 comes off its cam lobe, the rocker 20 will close the valve as it pivots about its follower 22 on account of the pivot shaft 26 being raised by the rocker 28.

Once the valve 14 has closed, the outer cams 16 return to their base circle and the middle cam 18 returns to its maximum lift dwell ready to start the next valve lift. In this portion of the cycle, the rockers 20 and 28 move even though there is no valve lift, so the control spring 34 is required to hold the follower 32 of the rocker 28 in contact with the cam 18 and the adjustment screws are required to prevent the hydraulic lash adjusters 24 of the outer pair of rockers 20 from over-expanding when there is clearance in the system.

During this portion of the cycle, the outer cam followers 22 lose contact with their cam lobes 16 and are brought back into contact by the start of the opening ramp on the outer cams 16.

The effect of the described valve mechanism is to separate the control of the valve opening and valve closing times of each valve event. It is convenient to view the cams 16 as being the valve opening cams and the cam 18 as the valve closing cam but of course the converse is equally valid.

The valve mechanism would normally be designed with a particular maximum valve lift and duration in mind. The duration of the event is reduced by advancing the phase of the closing cam 18 relative to the opening cams 16 and this will be accompanied by a reduction in the valve lift because the cam follower 32 of the closing cam 18 will come off the cam lobe before the cam followers 22 of the opening cams 16 reach the lobes of the cams 16.

If the closing cam 18 is retarded relative to the opening cams 16, lift and duration will increase until the maximum valve lift is produced by both cams 16 and 18 being at their maximum lift at the same time. If the closing cam 18 is retarded still further, the valve lift will remain constant at its maximum value, and the event duration will increase by the addition of a dwell at maximum valve lift.

The valve mechanism described has two valves 14 per cylinder but it will be appreciated that the invention can be applied to an engine with a single intake or exhaust valve per cylinder. In this case, it is desirable to maintain symmetry by providing a single opening cam 16 acting on the valve 14 by way of a rocker 20 and to pivot the rocker 20 on two rockers 28 in contact with two closing cams 18 arranged on opposite sides of the opening cam 16.

What is claimed is:

1. An overhead camshaft internal combustion engine having a valve mechanism which comprises an intake or exhaust poppet valve having a valve stem, two cams mounted for rotation about a common axis, a first rocker mounted on a pivot shaft and acting between the first cam and the valve stem, to open and close the poppet valve in synchronism with the rotation of the first cam, and a second rocker mounted in the engine on a fixed pivot shaft and acting between the second cam and the pivot shaft of the first rocker, to raise and lower the pivot point of the first rocker cyclically in synchronism with the rotation of the second cam.

2. An engine as claimed in claim 1, wherein the engine has two valves per cylinder, and the valve mechanism comprises two first rockers following the movements of two first cams which are arranged symmetrically on opposite sides of a single second cam and second rocker.

3. An engine as claimed in claim 2, wherein springs are provided to urge the followers of the second rockers into contact with the second cams.

4. An engine as claimed in claim 1, wherein the engine has a single valve per cylinder, and the pivot shaft of the first rocker is carried by two second rockers following two second cams which are symmetrically arranged one on each side of the first cam and first rocker.

5. An engine as claimed in claim 4, wherein a spring is provided to urge the followers of the second rocker into contact with the second cams.

6. An engine as claimed in claim 1, wherein a hydraulic lash adjuster is provided between the or each valve its associated first rocker.

7. An engine as claimed in claim 6, wherein an adjustable stop is associated with each first rocker to limit the expansion of the hydraulic lash adjuster.

8. An engine as claimed in claim 1, wherein a phase changing mechanism is provided to vary the relative phase of the first and second cams.

9. An engine as claimed in claim 1, wherein a phase change mechanism is provided to vary the phases of the first and the second cams simultaneously in relation to the phase of the engine crankshaft.

* * * * *